US008297778B2

(12) United States Patent
Jeffrey

(10) Patent No.: US 8,297,778 B2
(45) Date of Patent: Oct. 30, 2012

(54) PARTY BALLOON WITH ILLUMINATION DEVICE

(75) Inventor: Peter Jeffrey, Liverpool (GB)

(73) Assignee: Seatriever International Holdings Ltd., Cheshire (GB)

( * ) Notice: Subject to any disclaimer, the term of this patent is extended or adjusted under 35 U.S.C. 154(b) by 117 days.

(21) Appl. No.: 12/528,853

(22) PCT Filed: Feb. 11, 2008 (Under 37 CFR 1.47)

(86) PCT No.: PCT/GB2008/050088

§ 371 (c)(1), (2), (4) Date: Mar. 29, 2010

(87) PCT Pub. No.: WO2008/110832

PCT Pub. Date: Sep. 18, 2008

(65) Prior Publication Data

US 2010/0309654 A1 Dec. 9, 2010

(30) Foreign Application Priority Data

Mar. 9, 2007 (GB) ..... 0704575.0

(51) Int. Cl.
*F21L 4/00* (2006.01)

(52) U.S. Cl. ..... 362/189; 362/806; 362/363; 362/186

(58) Field of Classification Search ..... 362/555, 362/565, 84, 154, 186, 189, 806, 363, 362; 40/554, 214; 446/220–226
See application file for complete search history.

(56) References Cited

U.S. PATENT DOCUMENTS

| | | | | |
|---|---|---|---|---|
| 4,997,403 | A * | 3/1991 | Akman | 446/220 |
| 5,019,041 | A * | 5/1991 | Robinson et al. | 604/97.03 |
| 5,215,492 | A | 6/1993 | Kubiatowicz | |
| 5,499,941 | A * | 3/1996 | Penjuke, Sr. | 446/222 |
| 5,947,581 | A | 9/1999 | Schrimmer et al. | |
| 6,106,135 | A * | 8/2000 | Zingale et al. | 362/186 |
| 6,135,617 | A * | 10/2000 | Lai | 362/249.09 |
| 6,238,067 | B1 * | 5/2001 | Hirsch | 362/352 |
| 6,482,065 | B1 | 11/2002 | Blackman | |
| 7,077,533 | B2 * | 7/2006 | Weiser et al. | 359/883 |
| 7,147,536 | B1 * | 12/2006 | Hartelius | 446/220 |
| 7,204,740 | B2 * | 4/2007 | Petell | 446/220 |
| 7,244,267 | B2 * | 7/2007 | Huter et al. | 606/200 |
| 7,699,505 | B2 * | 4/2010 | Yang | 362/352 |
| 2002/0164919 | A1 | 11/2002 | Blackman et al. | |
| 2004/0233674 | A1 * | 11/2004 | Vanderschuit | 362/352 |
| 2006/0039138 | A1 * | 2/2006 | Oxborrow | 362/189 |
| 2006/0104070 | A1 * | 5/2006 | Carito | 362/398 |
| 2006/0291217 | A1 * | 12/2006 | Vanderschuit | 362/363 |
| 2008/0032589 | A1 * | 2/2008 | Sun | 446/220 |

* cited by examiner

*Primary Examiner* — Danielle Allen
(74) *Attorney, Agent, or Firm* — Notaro, Michalos & Zaccaria P.C.

(57) ABSTRACT

A party balloon (10) includes an expansible membrane with an inlet port (15) to allow entry of gas upon inflation and an illumination device having a light emitting diode (LED) (50) powered by at least one battery (54) and mounted inside the balloon (10). The illumination device (50) has a projection (58) that is attached to the expansible membrane, inside the balloon, by a clip or O-ring (59), fitted onto the projection (58) from outside the balloon. A strip of insulating material (53) is initially located between the battery or batteries (54) and the LED (50) and is capable of being withdrawn, prior to or upon inflation of the balloon (10), to light up the illumination device and the balloon.

6 Claims, 4 Drawing Sheets

PARTY BALLOON WITH ILLUMINATION DEVICE

FIELD OF THE INVENTION

This invention concerns a party balloon.

BACKGROUND OF THE INVENTION

In the context of the present invention the term "party balloon" means a balloon intended only for decorative or play purposes. Such balloons are usually inflated by air or helium or by a mixture of these. When inflated by air they may be blown up directly by exhaled breath, or by means of a pump attached to the neck of the balloon or by temporary connection to a canister of compressed air, then sealed in a variety of known ways by knotting or other fastener devices. When inflated using helium, the neck is connected to a supply of the relevant compressed gas or mixture for a short period until the desired inflation size is obtained, then disconnected and fastened. Use of helium is increasingly common to obtain balloons for decorative purposes which float up in the air and can be retained by tethering to small weights or can be allowed to rise to ceiling height.

Balloons have previously been proposed which have an illumination device mounted therein, for example as disclosed in US2002/0164919, US2004/0127138 and WO 2005/103557.

An object of the present invention is to provide a cost-effective alternative which is also particularly simple to assemble during manufacture and particularly simple to use.

The invention provides a party balloon comprising an expansible membrane with an inlet port to allow entry of gas upon inflation and an illumination device mounted to the expansible membrane, characterised in that the illumination device has a projection whereby it is attached to the expansible membrane inside the balloon by a clip or O-ring fitted onto the projection from outside the balloon.

Preferably, the illumination device comprises a light emitting diode (LED) powered by at least one battery, and insulating material is initially located between the battery or batteries and the LED, said material being capable of being withdrawn from extending between the battery or batteries and the LED to light up the LED and the balloon.

In preferred embodiments of the present invention a strip of insulating material is initially located between the battery or batteries and the LED, said strip then being withdrawn from extending between the battery or batteries and the LED prior to or upon inflation of the balloon.

In alternative embodiments within the scope of the invention a region of the expansible membrane may be initially located between the battery or batteries and the LED such that said region is automatically withdrawn from extending between the battery or batteries and the LED upon inflation of the balloon. This is less favourable as location of the membrane region between the LED contacts during manufacture risks damage to the membrane.

The illumination device is mounted to the inside of the balloon for safety reasons, particularly to minimise detachment or malfunction, and for ergonomic and aesthetic reasons.

In preferred embodiments the strip of insulating material conveniently extends to be accessible at the inlet port, or extends through the inlet port so that it can easily be grasped and withdrawn from extending between the battery or batteries and the LED to light up the LED and the balloon. Preferably the strip has a region of enlarged width at its outer end which remains outside the inlet port (neck) of the balloon and provides a tab which can be readily grasped manually. However, in order to prevent inadvertent pulling out of the strip during transport and handling of the uninflated balloon prior to use, the strip preferably has a second region of enlarged width at a spacing from the first such region, the width of said second region being chosen so that it tends to remain inside the inlet port (neck) of the balloon, with the rim of the balloon membrane lodged between the respective enlarged width regions unless a significant force is used to pull the strip outwardly of the balloon.

In other embodiments the strip of insulating material may being connected to the membrane or to the inlet port in such a manner that said strip will be automatically withdrawn from extending between the battery or batteries and the LED upon inflation of the balloon.

The invention will be described further, by way of example by reference to the accompanying drawings, in which:

DETAILED DESCRIPTION OF THE INVENTION

Figure 1:
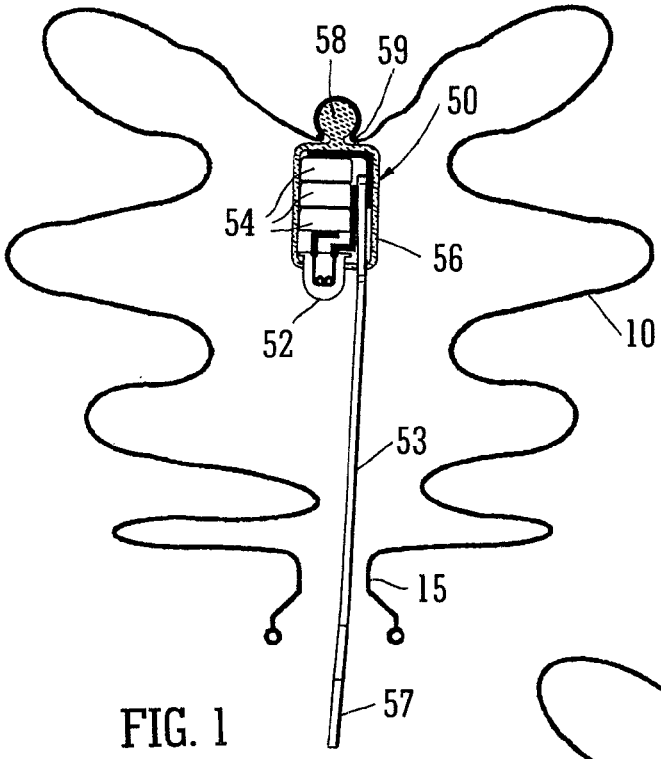
FIG. 1 shows a first practical embodiment of a party balloon incorporating an illumination device in accordance with the invention prior to its inflation.

As shown in the drawings, an illumination device in the form of a small LED unit 50 is mounted inside a balloon 10, which may be of any conventional type and material, in order to light up the balloon for decorative purposes. The unit 50 comprises a high-intensity LED 52 and three button cell batteries 54 mounted in a housing 56. The housing 56 is formed with a bead-like projection 58 which enables it to be attached inside the balloon 10 by an O-ring 59 fitted over the bead 58 from the outside of the balloon 10. The O-ring 59 may be just a small elastic band. Such attachment is preferably, as shown, at a location remote from and opposite to the neck 15 through which gas enters the balloon 10 upon its inflation.

Figure 2:
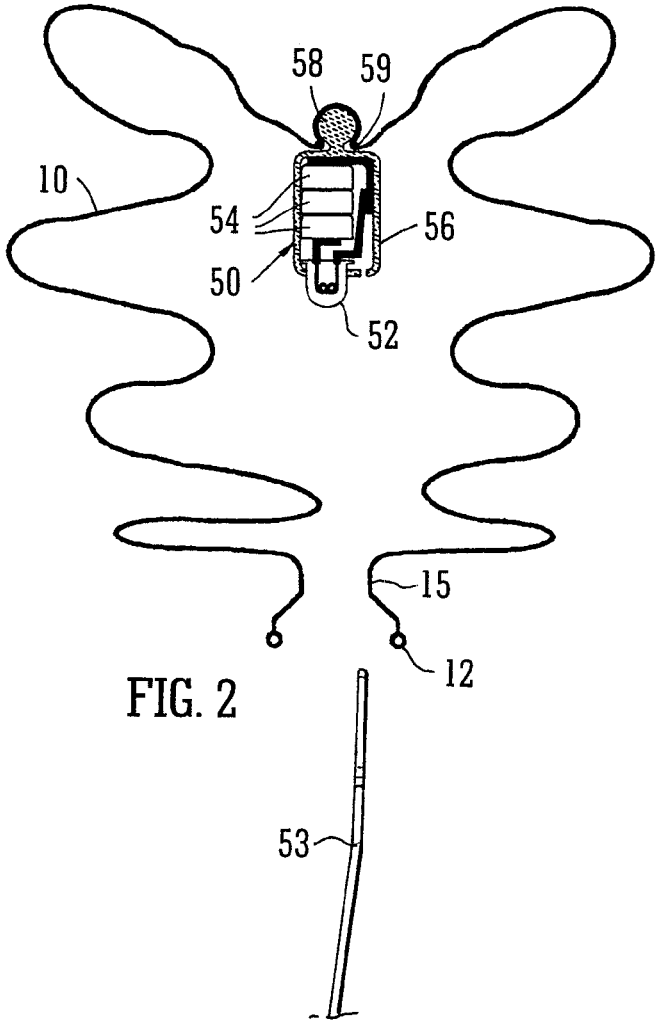
FIG. 2 shows the same balloon as it begins to be inflated.
Figure 4:
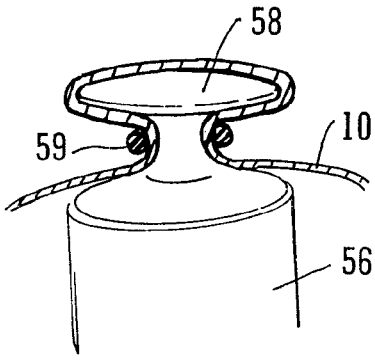
FIG. 4 is an enlarged fragmentary perspective view of the region of the balloon where the illumination device is attached in a modified embodiment of the balloon of the invention.
Figure 3:
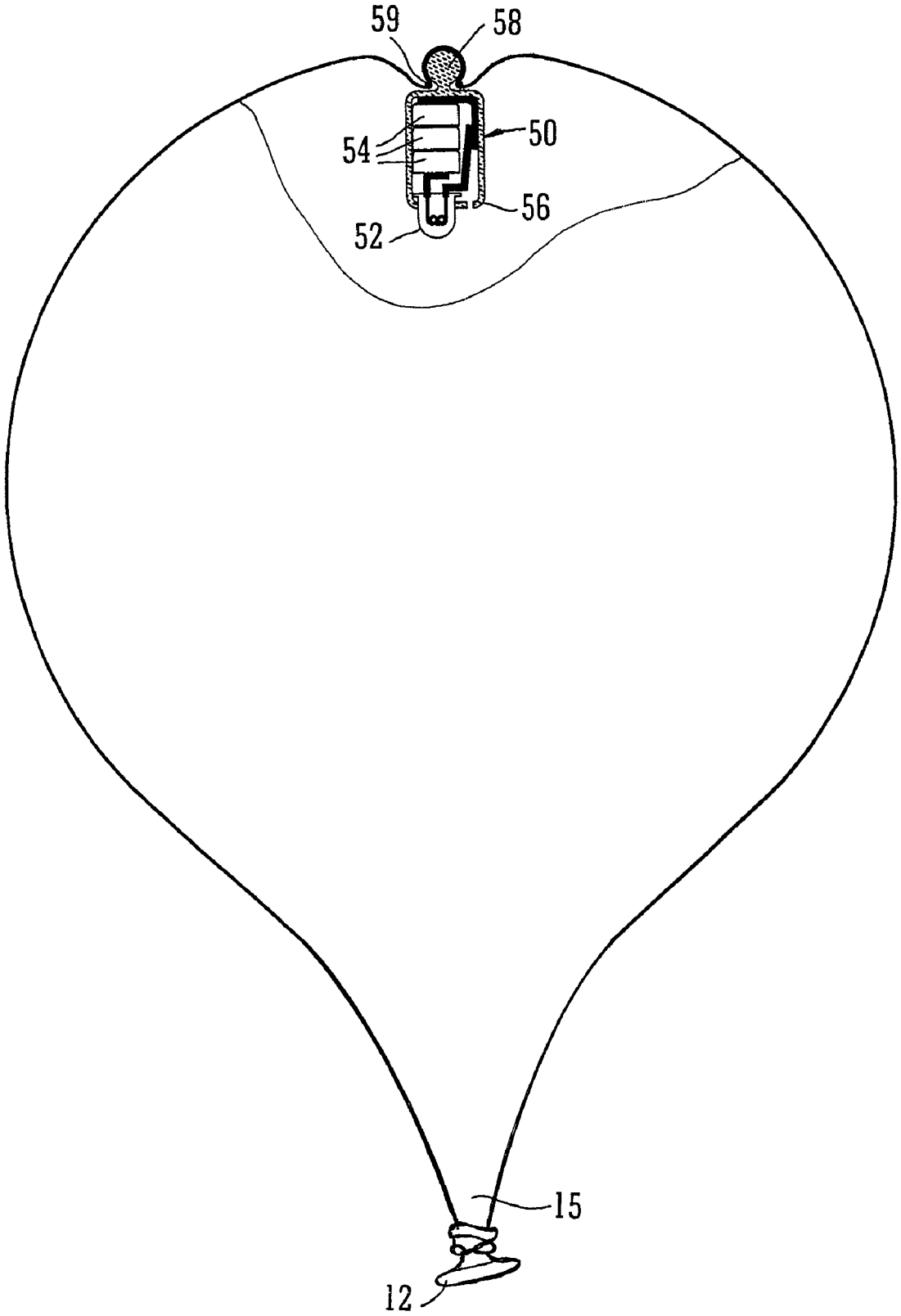
FIG. 3 shows the same balloon once inflated.

In the first embodiment of FIGS. 1 to 3 the bead 58 is shown as generally part spherical. In the modified embodiment shown in FIG. 4 the bead 58 is in the form of a flat button. This reduces any risk of the O-ring 59 lifting off during assembly of the balloon or later during transport will reduce.

As regards the LED unit 50, a strip of insulating material 53 is provided which initially projects between contacts for the LED 52 and the batteries 54 in order to break the circuit. An outer end of this strip 53 is also trapped in the neck 15 of the balloon 10 and has an arrow head shape enlargement 57 at said outer end, which cannot readily pass through the neck opening. Accordingly when the balloon 10 is to be inflated the strip 53 can readily be withdrawn from between the contacts, as shown in FIG. 2, by pulling on the enlargement 57, which is accessible outside the neck 15 of the balloon 10. Indeed, as the balloon expands such withdrawal of the strip 53 will probably happen automatically if the strip 53 has not already been removed manually or by mechanical means. Once the strip 53 is withdrawn the circuit between the batteries 54 and the LED 52 is completed and the latter lights up. Optionally, suitable circuit means may be included for intermittent illumination of the LED 52, thus greatly extending the possible battery life.

A soft plastic surround (not shown) may be added to the light unit 50 so as to eliminate the possibility of injury if the balloon explodes.

Figure 5:
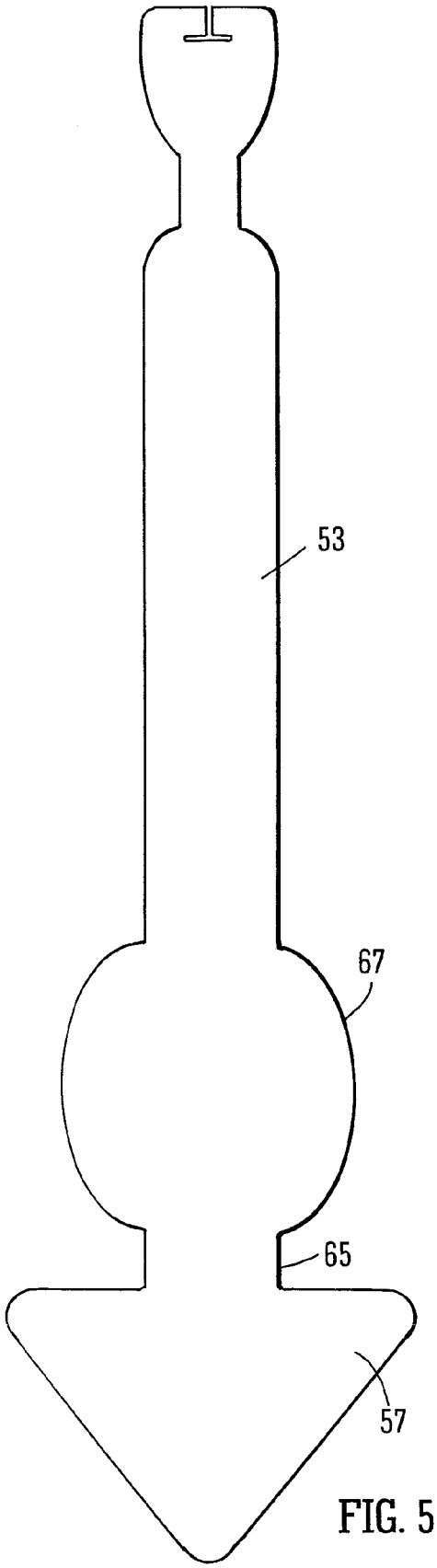
FIG. 5 is an enlarged plan view of the insulating strip used in the balloon of FIG. 1.
Figure 6:
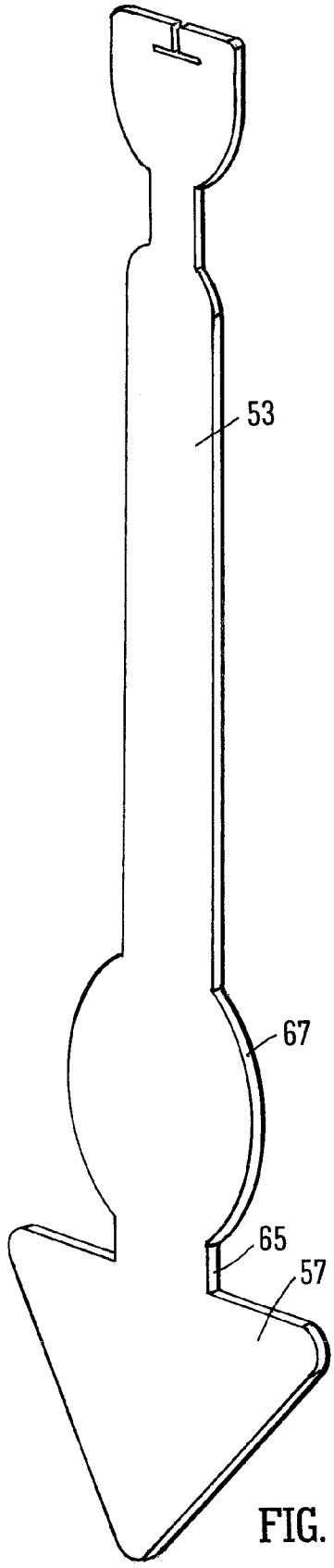
FIG. 6 is a corresponding perspective view of the insulating strip of FIG. 5.

FIGS. 5 and 6 illustrate one particular form of the strip of insulating material 53. This is provided with a second enlarged region 67 at a short spacing from the arrow head enlargement 57 at the outer end such that a notch 65 is disposed between these enlargements 57, 67. The second enlargement 67 is of such a width that it tends to remain inside the neck 15 of the balloon 10, with the thickened edge rim 12 of the balloon membrane lodged in the notch 65, until a significant force is used to pull the strip 53 outwardly of the balloon. This prevents inadvertent pulling out of the strip 53 during transport and handling of the uninflated balloon prior to use.

Figure 7:
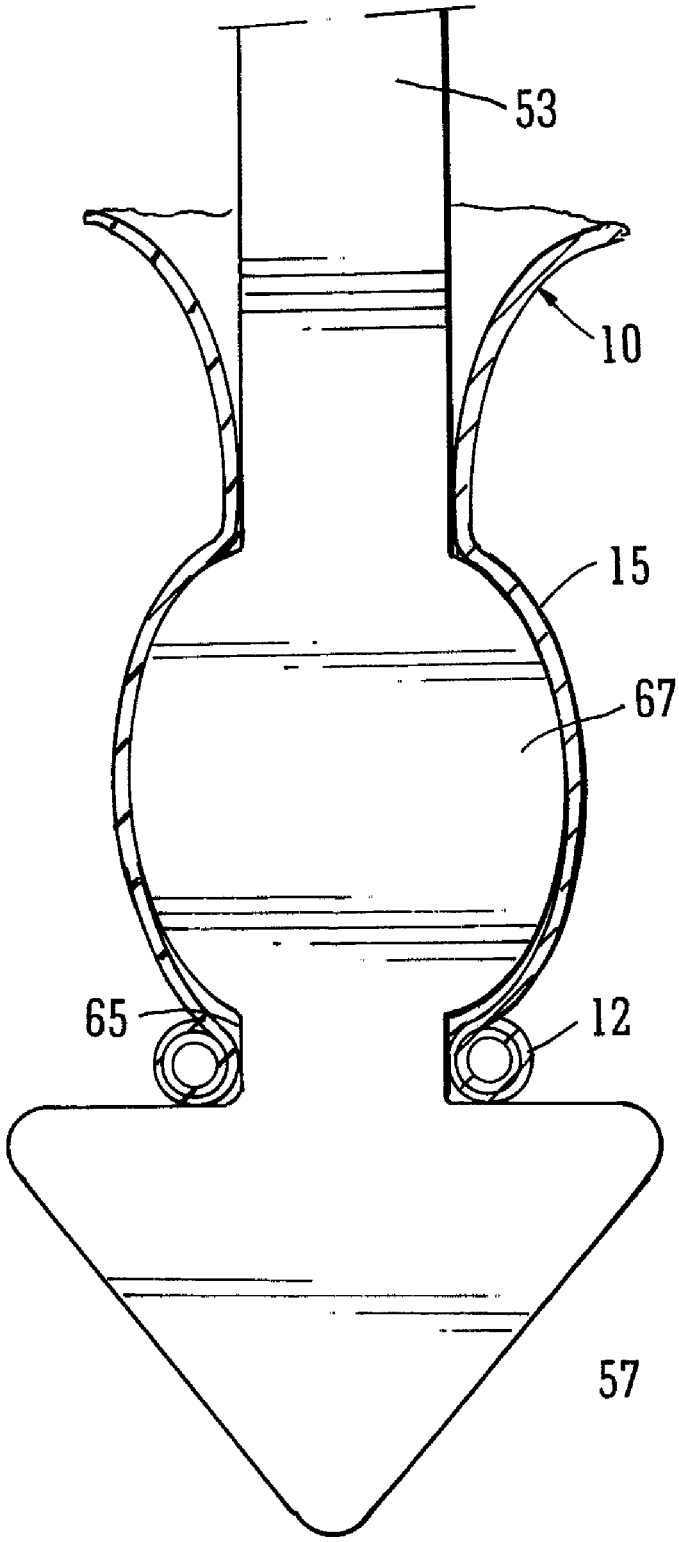
FIG. 7 is an enlarged fragmentary partially sectional view showing the insulating strip of FIGS. 5 and 6 in its initial position in the neck of the balloon as in FIG. 1.

The foregoing is illustrative and not limitative of the scope of the invention and variations in detail are possible in other embodiments. In particular, the strip of insulating material may be of simpler form than that illustrated in FIGS. 5, 6 and 7, without either enlarged width region. Also, the form of the illumination device may differ from the illustrated embodiment. The bead 58 may be replaced by a projection of different shape and the O-ring 59 may be replaced by a clip.

The invention claimed is:

1. A party balloon comprising:

an expansible membrane with an inlet port that allows entry of gas upon inflation;

an illumination device mounted inside the balloon to an inner surface of said expansible membrane at a location on said inner surface which is opposite from said inlet port, said illumination device comprising a housing, a light emitting device mounted in said housing and at least one battery power source mounted in said housing, said at least one battery power source being for powering said light emitting device, said housing of said illumination device having a projection extending outwards from said housing;

a clip or O-ring fitted over said projection from outside the balloon and attaching said housing of said illumination device to said inner surface of said membrane at a location opposite said inlet port, said housing being supported in its position opposite said inlet port by the expansible membrane only, and said housing not connected to any other support means;

a strip of insulating material releasably disposed between said at least one battery and said light emitting device;

wherein said strip of insulating material extends through said inlet port to an outer end region of said strip of material, which outer end region is of enlarged width;

wherein when said strip of insulating material is withdrawn from between said at least one battery and said light emitting device, said illumination device and said balloon light up.

2. A party balloon according to claim 1, wherein said projection is in the form of a generally part spherical bead or a flattened button.

3. A party balloon according to claim 1, wherein said light-emitting device comprises a light emitting diode (LED).

4. A party balloon according to claim 1, wherein the outer end region of the strip of insulating material, which is of enlarged width, is arrowhead-shaped.

5. A party balloon according to claim 1, wherein said strip of material also has a second region of enlarged width at a spacing from said outer end region of enlarged width, the width of said second region being chosen so that said second region tends to remain inside said inlet port of the balloon, with a rim of the balloon membrane lodged between the outer end region of enlarged width and the second region of enlarged width, unless a significant force is used to pull the strip outwardly of the balloon.

6. A party balloon according to claim 5, wherein the second region of enlarged width of the strip of insulating material is of approximately circular shape.

* * * * *